United States Patent [19]

Klein

[11] Patent Number: 4,699,278

[45] Date of Patent: Oct. 13, 1987

[54] ADJUSTABLE STOP FOR MERCHANDISE DISPLAY HOOKS

[75] Inventor: Max S. Klein, West Bloomfield Township, Oakland County, Mich.

[73] Assignee: Klein Plastic Products, Inc., Southfield, Mich.

[21] Appl. No.: 843,026

[22] Filed: Mar. 24, 1986

[51] Int. Cl.[4] ..... A47F 7/00

[52] U.S. Cl. ..... 211/57.1; 211/54.1; 248/222.1; 24/563

[58] Field of Search ..... 211/59.1, 57.1, 54.1, 211/70.6, 69; 248/214, 221.3, 222.1; 24/563, 557, 561; 206/806

[56] References Cited

U.S. PATENT DOCUMENTS

| | | | |
|---|---|---|---|
| 2,626,061 | 1/1953 | Girouard | 211/59 |
| 2,824,651 | 2/1958 | Davis | 211/69 |
| 4,217,986 | 8/1980 | Brown | 211/57.1 |
| 4,315,569 | 2/1982 | Jaeschke | 206/806 X |
| 4,471,512 | 9/1984 | Thalenfeld | 24/557 |

*Primary Examiner*—Ramon S. Britts
*Assistant Examiner*—Blair M. Johnson
*Attorney, Agent, or Firm*—Basile and Hanlon

[57] ABSTRACT

An adjustable stop for positioning merchandise longitudinally of an elongate rod-like support of the type employed in pegboard merchandise displays takes the form of a flat resilient member of polygonal configuration having rod receiving openings sized to frictionally grip a rod support while being capable of being manually forced to a selected position on the rod. One opening is provided with two or more radially outwardly extending slots to accommodate mounting of the stop on a rod having a spherical enlargement at its end.

1 Claim, 3 Drawing Figures

ADJUSTABLE STOP FOR MERCHANDISE DISPLAY HOOKS

BACKGROUND OF THE INVENTION

The present invention is directed to an adjustable stop employed to locate merchandise longitudinally of an elongate merchandise display hook of the type employed in pegboard merchandise displays. Such hooks are employed to support a plurality of units of merchandise, typically merchandise which is carried on a card having a hole through the top which is employed to suspend the card, with similar cards being carried on the hook one behind the other.

Adjustable stops employed for this purpose are known in the prior art; see, for example, U.S. Pat. Nos. to Girouard 2,626,061, Brown 4,217,986 and Thalenfeld 4,471,512. The primary problem addressed by these devices involves the fact that in the typical pegboard merchandise display, in order to make maximum usage of the display, many products are displayed in close proximity to each other. As the supply of products on a given hook diminishes, the remaining products on the hook tend to collect near the back of the hook and are then partially concealed from the customer by products on adjacent hooks. The stops, which typically are resiliently clipped to the hook as in the Brown and Thalenfeld patents referred to above, are placed upon the hook behind the rearwardmost product and may be moved forwardly along the hook to be sure that the forwardmost article is maintained in clear view of the customer at the front end portion of the hook.

Merchandise display hooks for pegboard displays are available from many manufacturers in a wide range of styles, lengths and rod diameters. Typically, the hook is formed from rod stock with an elongate, horizontal product supporting portion which may terminate at its forward end with a short, upwardly inclined section or an enlarged, spherical ball to prevent products from sliding off the front of the hook. In order to perform their intended function, the stops or positioning devices must frictionally grip the hook firmly enough to remain stationary under normal circumstances, but not so firmly as to interfere with manual displacement of the stop along the hook when the position of the stop must be readjusted. The rod stock from which the hooks are made is manufactured in numerous standard diameters within the roughly ⅛ to ¼ inch diameter range. This encompasses the vast majority of hooks employed for merchandise display purposes, and presents six or more available standard diameters or gages.

Most prior art stops fail to take this variation in diameter into account, with the result that there the stop takes the form of a simple hole through a resilient member, as in the Girouard patent referred to above, the stop is ineffective on hooks constructed of rod stock of a diameter which differs by any substantial amount from the diameter for which the stop was designed. Where the stop is slotted to resiliently grip the hook, in clothes pin fashion between opposed legs, a similar result is achieved, combined with the distinct possibility that the stop will simply fall off hooks of minimum diameter. The through hole type stop of the type shown in the Girouard patent further is frequently unusable on those hooks which rely upon an enlarged ball at the free end to retain the product on the hook.

The present invention is directed to a merchandise positioning stock usable upon merchandise display hooks of the type discussed above having a wide range of rod diameters and capable of being used on hooks having enlarged merchandise retaining balls at their distal ends.

SUMMARY OF THE INVENTION

The adjustable stop of the present invention takes the form of a one-piece member of a natural or synthetic elastomeric material which is formed, in the disclosed embodiment, into a generally triangular shape. Cylindrical openings through the member are formed adjacent each corner of the triangular configuration, two of these openings being of different diameters and the third opening including two slots extending through the member and extending radially outwardly from the circular opening. The diameters of the first two mentioned openings are selected to be such as to provide a reasonable resilient grip combined with a reasonable ease of adjustment of the member longitudinally along rods of diameters falling within a general size range of about ⅛ to about ¼ inch. The opening formed with the outwardly extending radial slots enables the device to be slipped onto a rod having a ball enlargement at its distal end, and the presence of the slots also enables this last opening to be usable on rods of relatively enlarged diameter.

Other objects and features of the invention will become apparent by reference to the following specification and to the drawings.

IN THE DRAWINGS

Figure 1:
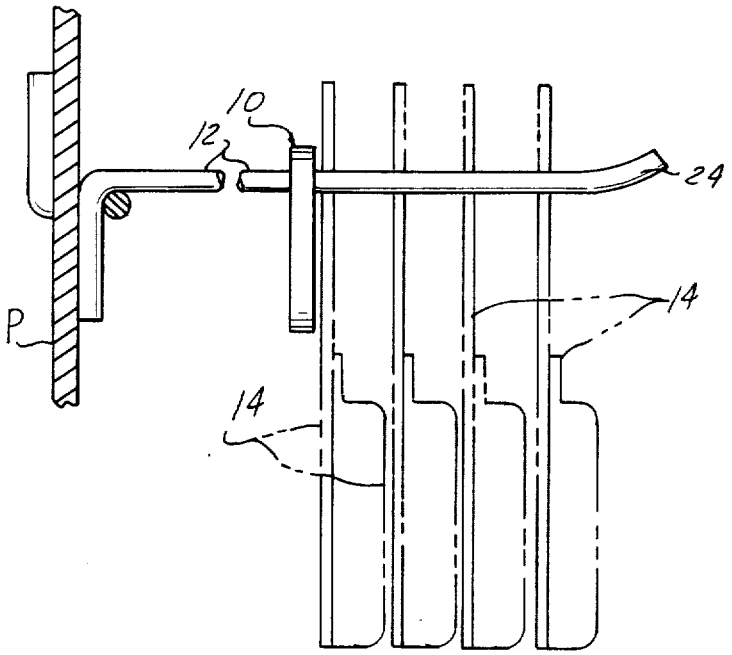
FIG. 1 is a side elevational view, with certain parts broken away or shown in section, of a stop device embodying the present invention in a typical use environment.

In FIG. 1, an adjustable stop designated generally 10 embodying the present invention is shown installed in a typical application upon a rod-like merchandise display hook 12 mounted in a pegboard P which is suitably fixedly supported by conventional means, not shown. The hook 12 is shown supporting a group of like units of merchandise 14 indicated in broken line suspended in a well-known manner one behind each other upon hook 12. In FIG. 1 the adjustable stop 10 is shown positioned on hook 12 to maintain the front merchandise unit 14 (right-hand unit as viewed in FIG. 1) closely adjacent the distal end of hook 12. As additional merchandise units 14 are removed from the hook 12, the adjustable stop 10 will be manually shifted along rod 12 to the right as viewed in FIG. 1 to position the remaining units adjacent the front or right-hand end of rod 12 where they will be clearly visible to customers and not partially concealed by merchandise supported on closely adjacent hooks (not shown).

Figure 2:
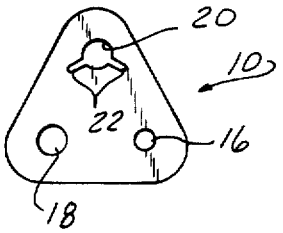
FIG. 2 is a front view of the stop of FIG. 1.
Figure 3:
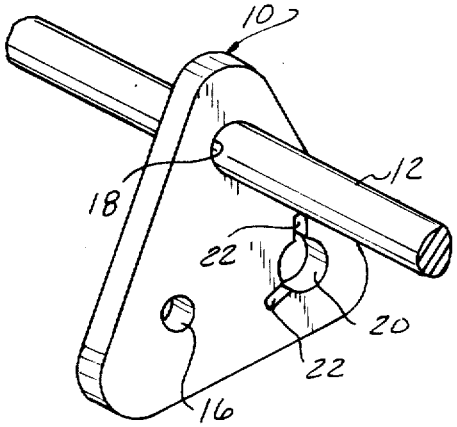
FIG. 3 is a perspective view, with certain parts broken away, showing the stop per se installed upon a rod.

Adjustable stop 10 is shown in side view in FIG. 1 and is formed from a relatively flat piece or member of a suitable natural or synthetic elastomeric material having properties of resilience and firmness similar to a reasonably firm, but not hard, rubber. As viewed from the front in FIG. 2, the stop 10 is of a generally equilateral triangular configuration and is formed with circular holes 16 and 18 of different diameter adjacent two corners of the member. A third opening adjacent the remaining corner is of circular configuration with two slots 22 extending radially outwardly from the central opening 20. The various openings 16, 18 and 20 and slots 22 pass entirely through the stop 10 and are intended to resiliently frictionally grip the rod-like display hook 12 which, as indicated in FIG. 3, is passed through a selected one of the openings. The opening of the stop is selected in accordance with the diameter of the rod-like display hook 12 on which the stop 10 is to be used. As explained above, rod stock from which hooks 12 are manufactured is available in a number of standardized diameters designated by wire gage sizes. These gage sizes may differ from each other by diameter changes of 0.01 to 0.02 inches. Precise dimensioning of the hook 12 is not critical insofar as its diameter is concerned with the net result that substantial variations in hook diameters are encountered at their point of end use.

To perform its merchandise positioning function, the stop must resiliently grip the rod 12 with a force sufficient to resist inadvertent displacement as, for example, when a customer might attempt to push back merchandise on one hook for more convenient access to merchandise on an adjacent hook. At the same time, the resilient grip of the stop to the rod should not be so tight as to make it difficult to manually slide the stop along rod 12 when it is desired to change the position of the stop on the rod. By making the holes 16 and 18 of different diameter, a reasonably wide range of rod diameter variations can be accommodated by the stop.

Most display hooks are formed as shown in FIG. 1 with an upwardly inclined distal end section 24 which resists inadvertent sliding of the endmost merchandise unit off the distal end of the rod. However, in some instances this merchandise retaining function is accomplished by forming the rod 12 with an enlarged diameter ball at its distal end. The slotted opening 20 will accommodate installation of the stop 10 on a rod of this latter type, the radial slots accommodating a greater amount of expansion of the opening to pass the stop over the ball retainer. The slotted opening 20 is also useful in connection with rod 12 of larger than normal diameter.

While one embodiment of the invention has been described in detail, it will be apparent to those skilled in the art the disclosed embodiment may be modified. Therefore, the foregoing description is to be considered exemplary, rather than limiting, and the true scope of the invention is that defined in the following claims.

I claim:

1. In combination with an elongated rod-like hook of the type employed in pegboard merchandise displays, said hook having a diametric cross-section an adjustable stop for adjustably longitudinally positioning merchandise hung upon said rod-like hook, said stop comprising a one-piece member of resilient material of a polygonal configuration having an exterior periphery, a plurality of rod receiving openings extending through said one-piece member respectively located adjacent each of its corners, said openings having configurations corresponding generally to the cross-section of said rod-like hook, at least two of said rod receiving openings being of differing diameters adapted to receive and frictionally grip respective rod-like hooks of differing diameter, and at least one additional opening having an essentially circular central aperture having a given diameter and at least one elongated slot contiguous with and extending radially outwardly from said circular central aperture to an outer end located within the periphery defined by said one-piece member accommodating expansion of said circular central aperture to a diameter larger than the diameter of either of said rod receiving openings upon insertion of said rod-like hook through said circular central aperture, said elongated slot having a width less than the diameter of said circular central aperture.

* * * * *

UNITED STATES PATENT AND TRADEMARK OFFICE

CERTIFICATE OF CORRECTION

PATENT NO. : 4,699,278

DATED : October 13, 1987

INVENTOR(S) : Max S. Klein

It is certified that error appears in the above-identified patent and that said Letters Patent is hereby corrected as shown below:

On the Title Page, in the Abstract, Section [57], line 3, delete "pegboard" and insert --PEGBOARD--.

Column 1, line 9, delete "pegboard" and insert --PEGBOARD--.

Column 1, line 19, delete "pegboard" and insert --PEGBOARD--.

Column 1, line 33, delete "pegboard" and insert --PEGBOARD--.

Column 2, line 43, delete "pegboard" and insert --PEGBOARD--.

Column 4, line 13, delete "pegboard" and insert --PEGBOARD--.

Column 4, line 14, after "cross-section", insert --,--.

Signed and Sealed this

Twenty-eighth Day of June, 1988

*Attest:*

*Attesting Officer*

DONALD J. QUIGG

*Commissioner of Patents and Trademarks*